US005977048A

United States Patent [19]

Welch et al.

[11] Patent Number: 5,977,048

[45] Date of Patent: Nov. 2, 1999

[54] AQUEOUS BASED SOLVENT FREE CLEANING DEGREASER COMPOSITIONS CONTAINING ALCOHOL ALKOXYLATES, POLYOXYALKYLENE BLOCK COPOLYMERS, AND FATTY ALCOHOLS HAVING OXYETHYLATE MOIETIES

[75] Inventors: Michael C. Welch, Woodhaven; Charles O. Kerobo, Southfield; Suzanne M. Gessner, Ypsilanti; Sonia J. Patterson, Detroit, all of Mich.

[73] Assignee: BASF Corporation, Mt. Olive, N.J.

[21] Appl. No.: 08/902,436

[22] Filed: Jul. 29, 1997

[51] Int. Cl.[6] ..... C11D 1/825; C11D 3/37

[52] U.S. Cl. ..... 510/365; 510/218; 510/245; 510/280; 510/422; 510/434; 510/476; 510/506

[58] Field of Search ..... 510/365, 245, 510/422, 506, 514, 421, 434, 218, 280, 476; 252/FOR 243, FOR 242

[56] References Cited

U.S. PATENT DOCUMENTS

| | | | |
|---|---|---|---|
| 3,382,176 | 5/1968 | Jakobi et al. | 510/422 |
| 4,187,190 | 2/1980 | McLaughlin et al. | 510/233 |
| 4,233,171 | 11/1980 | McLaughlin et al. | 510/231 |
| 4,233,172 | 11/1980 | McLaughlin et al. | 510/231 |
| 4,272,394 | 6/1981 | Kaneko | 510/231 |
| 4,836,951 | 6/1989 | Totten et al. | 510/220 |
| 5,049,303 | 9/1991 | Secemski et al. | 510/356 |
| 5,114,607 | 5/1992 | Deck et al. | 510/254 |
| 5,126,068 | 6/1992 | Burke et al. | 510/421 |
| 5,382,376 | 1/1995 | Michael et al. | 510/413 |
| 5,501,816 | 3/1996 | Burke et al. | 510/365 |
| 5,516,452 | 5/1996 | Welch et al. | 510/514 |
| 5,518,648 | 5/1996 | Welch et al. | 510/220 |
| 5,536,348 | 7/1996 | Scialla et al. | 510/372 |
| 5,558,109 | 9/1996 | Cala et al. | 134/2 |
| 5,559,091 | 9/1996 | Geboes et al. | 510/422 |
| 5,821,213 | 10/1998 | Burke et al. | 510/365 |

*Primary Examiner*—Ardith Hertzog
*Attorney, Agent, or Firm*—Nixon & Vanderhye P.C.

[57] ABSTRACT

The present invention relates to an aqueous based, solvent free degreaser composition, comprising (a) alcohol alkoxylate with a fatty alcohol moiety, (b) polyoxyalkylene block copolymer, and (c) a fatty alcohol having an oxyethylate moiety.

10 Claims, No Drawings

AQUEOUS BASED SOLVENT FREE CLEANING DEGREASER COMPOSITIONS CONTAINING ALCOHOL ALKOXYLATES, POLYOXYALKYLENE BLOCK COPOLYMERS, AND FATTY ALCOHOLS HAVING OXYETHYLATE MOIETIES

FIELD OF THE INVENTION

The present invention relates to an aqueous based, tri-blend solvent free degreaser composition, and more particularly to a mixture of nonionic surfactants which effectively clean oils and greases from a variety of surfaces.

BACKGROUND OF THE INVENTION

The demand for degreasing formulations for a myriad of cleaning applications is well known. Target applications range from the light cleaning of printed electronic circuit boards to the cleaning of used automotive parts. Many formulations for these purposes contain varied levels of volatile solvents to efficiently degrease surfaces. Many heavy duty degreasing operations use heated solvent baths.

Recent concerns for environmental and toxicological effects of solvents and solvent baths have caused a full search for aqueous degreasing systems without solvent. Few surfactant based systems have been successful without at least a minor amount of solvent, for the dual purpose of cleaning and defoaming. Hence, industrial and institutional cleaning operations that require degreasing must reconcile their desire to be socially conscious with the need to remain effective.

The use of glycol ether solvents or cycloalkanes in cleaning compositions, in combination with anionic and/or nonionic surfactants, are known in the art. Examples of such systems may be found in Wittel et al., EP 376367; Kao Corporation, JP 3062896; Lyubarskay et al., SU 1300041; Bedo et al., SU T56873; and Dudesek et al., CS 220985.

Bobsein, et al, U.S. Pat. No. 4,663,082, teach a high pH water based industrial cleaning composition comprising a series of anionic surfactants, builders and alkalinity agents. In addition, the patentees teach the use of phosphate builders and chelating agents.

Henkel AG World Organization Patent No. 91/10718 discloses a composition requiring at least one anionic surfactant and at least one monocarboxylic acid.

European Patent No. 0392394B1 issued to the Nippon Paint Co. of Japan teaches a degreasing composition and a surfactant package comprising a nonionic surfactant of the polyoxyalkylene ether type with a phosphate polyethylene oxide adduct. This mix is combined with a necessary amount of alkali builder of varying types. However, the phosphate moiety is responsible for increasing the generation of foam. Finally, residual phosphorous is an environmental concern. The nominal amount of alkali builder also results in a caustic solution.

Further, European Patent No. 0084411A1 assigned to Albright & Wilson Limited teaches the use of a wide variety of nonionic surfactants or a phosphate ester with an alkanolamide and solvent U.S. Pat. No. 5,536,438, discloses a cleaning composition containing four nonionic surfactants (fatty alcohol ethoxylates) of different HLB values; U.S. Pat. No. 5,518,648 discloses a dishwashing composition comprising 2 nonionic surfactants of the alcohol alkoxylate type and a block copolymer of EO/PO; U.S. Pat. No. 5,382,376, discloses a detergent composition comprising: (a) EO/PO/EO block copolymer, (b) cosurfactants such as EO/PO/EO block copolymers with a hydrophobic moiety, (c) hydrophobic solvents such as alkylbenzenes; U.S. Pat. No. 5,049,376 discloses a detergent composition comprising surfactants selected from anionic, zwitterionic, cationic and nonionic; non phosphate builders, EO/PO block copolymers, and a polycarboxylate polymer.

Finally, U.S. Pat. No. 5,501,816 (U.S. '816) discloses ternary surfactant blends comprising: alcohol alkoxylate with a fatty alcohol moiety, alkyl phenol alkoxylates and alkyl oxyethylate. U.S. '816 also discloses that the addition of polycarboxylate polymers enhances the efficacy of the degreaser compositions.

Conversely, Applicants cleaning composition contains a polyoxyalkylene block copolymer and provides safe and effective cleaning power. Further, the present invention does not require the use of polkycarboxylates to enhance cleaning efficacy. Finally, the present invention eliminates the use of alkylphenolalkoxylates for which environmental concerns have been raised.

SUMMARY OF THE INVENTION

The present invention relates to an aqueous based, solvent free degreaser composition, comprising on a weight basis:

(a) about 0.15%–5% of at least one alcohol alkoxylate with a fatty alcohol moiety selected from the group of compounds of the Formula:

$$R[\underset{\underset{R'}{|}}{OCHCH_2})_m/(OCH_2CH_2)_n][(OCH_2CH_2)_o/(\underset{\underset{R''}{|}}{OCH_2CH_2})_p]R'''$$

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2$ $CH_3$, and mixtures thereof, R" is —$CH_3$, —$CH_2$ $CH_3$, and mixtures thereof, and R'" is —OH, —$CH_3$, —O—$C_3$–$C_{18}$ hydroxyalkyl group and mixtures thereof;

(b) about 0.15%–5% of a nonionic surfactant characterized as a block or heteric/block polyoxyalkylene polymer having a cloud point in a 1 weight percent aqueous solution of about 10° C. to about 40° C. selected from the group consisting of at least one of the polyoxyalkylenes having the Formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0 to 26, m is within the range of about 0 to 110, and n is within the range of about 0 to 26. The molecular weight range of polyoxyalkylene copolymers encompassed by Formula I, II, III is about 1,000 to 20,000.

The preferred polyoxyalkylene copolymers useful in the practice of the present invention are represented by Formula II. Specifically, in Formula II, A is preferably oxypropylene or oxybutylene, most preferably, oxypropylene. The molecular weight of Formula II is from about 1,000 to 12,000, most preferably from 1000 to 5000 and most preferably from about 1000 to 2600.

(c) about 0.15–5% of at least one fatty alcohol having oxyethylate moieties of the following Formula:

$$R(OCH_2CH_2)_xOH$$

wherein R is a $C_{10}$ to $C_{13}$ branched or straight chain alkyl group and x is within the range of about 4 to 10; and (d) water.

The above formulation may optionally also contain about 0.005 to 1% of at least one polycarboxylate polymer of the following Formula:

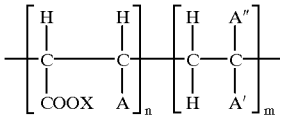

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

DETAILED DESCRIPTION

The present invention relates to an aqueous based, solvent free degreaser composition, comprising on a weight basis:

(a) about 0.15–5% of at least one alcohol alkoxylate with a fatty alcohol moiety selected from the group of compounds of the Formula:

$$R[\underset{\underset{R'}{|}}{OCHCH_2})_m/(OCH_2CH_2)_n][(OCH_2CH_2)_o/(OCH_2\underset{\underset{R''}{|}}{CH_2})_p]R'''$$

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2$ $CH_3$, and mixtures thereof, R" is —$CH_3$, —$CH_2$ $CH_3$, and mixtures thereof, and R"' is —OH, —$CH_3$, —O—$C_3$–$C_{18}$ hydroxyalkyl group and mixtures thereof;

(b) about 0.15 to 5% of a nonionic surfactant characterized as a block or heteric/block polyoxyalkylene polymer having a cloud point in a 1 weight percent aqueous solution of about 100° C. to about 400° C. selected from the group consisting of at least one of the polyoxyalkylenes having the Formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0 to 26, m is within the range of about 0 to 110, and n is within the range of about 0 to 26. The molecular weight range of the polyoxyalkylene block copolymer encompassed by Formula I, II, III is about 1,000 to 20,000.

The preferred polyoxyalkylene copolymers useful in the practice of the present invention are represented by Formula II. Specifically, in Formula II, A is preferably oxypropylene or oxybutylene, most preferably, oxypropylene. The molecular weight of Formula II is from about 1,000 to 12,000, most preferably from 1000 to 5000 and most preferably from about 1000 to 2600.

(c) about 0.15–5% of at least one fatty alcohol having oxyethylate moieties of the following Formula:

$$R(OCH_2CH_2)_xOH$$

wherein R is a $C_{10}$ to $C_{13}$ branched or straight chain alkyl group and x is within the range of about 4 to 10, preferably 6 to 8 and (d) water.

The above formulation may optionally also contain about 0.005 to 1 % of at least one polycarboxylate polymer of the following Formula:

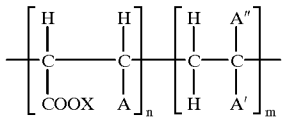

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

Preparation of the Degreaser Composition of the Present Invention

The cleaning composition of the present invention is prepared by blending elements (a), (b), and (c) according to methods known to those skilled in the art. The three components (a), (b) and (c) are also known as non ionic surfactants.

(a) The Alcohol Alkoxylate with a Fatty Alcohol Moiety

The alcohol alkoxylate with a fatty alcohol moiety (a) has the following Formula:

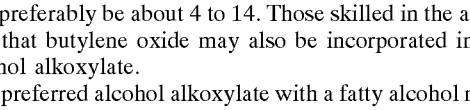

wherein R is a $C_8$ to $C_{18}$ branched or straight chain alkyl group, m is within the range of about 0 to 14, n is within the range of about 0 to 14, o is within the range of about 0 to 14, p is within the range of about 0 to 14, and R' is —$CH_3$, —$CH_2$ $CH_3$, and mixtures thereof, R" is —$CH_3$, —$CH_2$ $CH_3$, and mixtures thereof, and R"' is —OH, —$CH_3$, —O—$C_3$–$C_{18}$ hydroxyalkyl group and mixtures thereof. R"' can be, for example, —O—$C_4$ $H_9$. In a preferred embodiment, the oxyethylate level or value of n plus o will range from about 5 to 12, and even more preferably from about 4 to 10. The oxypropylate level or value of m plus p will preferably be about 4 to 14. Those skilled in the art may find that butylene oxide may also be incorporated into the alcohol alkoxylate.

A preferred alcohol alkoxylate with a fatty alcohol moiety has a carbon chain (R) of $C_{12-15}$ with approximately 10 moles total of oxyethylate and approximately 5 moles total of oxypropylate, where m=1.5, n=1, o=9, and p=3.5. Another preferred alcohol alkoxylate with a fatty alcohol moiety has a $C_{8-10}$ carbon chain length (R) with approximately 10 moles oxyethylate and approximately 14 moles oxypropylate, wherein n=1, o=9, m=7, and p=7.

The alcohol alkoxylate with a fatty alcohol moiety will make up about 0.15 to 5.0% by weight of the total degreaser composition. More preferably, this component will comprise about 0.17 to 3.3% by weight of the total composition, and even desirably will be present in an amount of about 0.5 to 2% by weight of the total formulation.

(b) The Polyoxyalkylene Block Copolymer

The polyoxyalkylene block copolymer is a nonionic surfactant characterized as a block or heteric/block polyoxyalkylene having a cloud point in a 1 weight percent aqueous solution of about 10° C. to about 40° C. selected from the group consisting of at least one of the polyoxyalkylenes having the Formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran or mixtures thereof wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0–26, m is within the range of about 0 to 110, and n is within the range of about 0 to 26. The molecular weight range of the polyoxyalkylene block copolymers encompassed by Formula I, II and III is about 1,000 to 20,000.

The preferred polyoxyalkylene copolymers useful in the practice of the present invention are represented by Formula II. Specifically, in Formula II, A is preferably oxypropylene or oxybutylene, most preferably, oxypropylene. The molecular weight of Formula II is from about 1,000 to 12,000, most preferably from 1,000 to 5,000, and most preferably from about 1,000 to 2,600.

In the most preferred embodiment of Formula II, A is oxypropylene and the molecular molecular weight is about 2,500.

(c) The Fatty Alcohol Having Oxyethylate Moieties

The fatty alcohol having oxyethylate moieties (c) has the following Formula:

$$R(OCH_2CH_2)_xOH$$

wherein R is a $C_{10}$ to $C_{13}$ branched or straight chain alkyl group and x is within the range of about 4 to 10.

Preferred fatty alcohols having oxyethylate moieties are available from BASF Corporation under the tradename ICONOL™ TDA 10, wherein R=$C_{13}$ and x=10 and ICONOL™ DA 4, wherein R=$C_{10}$ and x=4.

The fatty alcohol having oxyethylate moieties will comprise about 0.15 to 5.0% by weight of the total degreaser composition. More preferably, this component will comprise about 0.17 to 3.3% by weight of the total composition, and most preferably about 0.5 to 2.2% by weight of the total degreaser composition.

The relative ratios of the three nonionic surfactants (a), (b) and (c) set forth above may range from about 1:1:1 to about 1:1:2 and from about 1:2:1 to about 2:1:1 and fractional combinations thereof (e.g. 0.5:1:1.5). In a preferred embodiment, there will be equal weight concentrations of all three nonionic surfactant components.

The remainder of the degreaser composition will comprise water.

It has also been found that the ternary combination of the above combination of nonionic surfactants may optionally contain at least one polycarboxylate based polymer or copolymer further enhances the efficacy of the degreaser composition.

Preferably, the polycarboxylate polymer or copolymer has the following Formula:

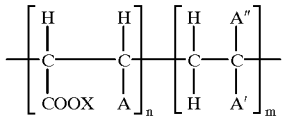

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer or copolymer is within the range of about 1,000 to 70,000. (Unless otherwise specified, all molecular weights herein are expressed in terms of weight average molecular weight, or M(w)).

Polyacrylic acid having the above Formula is useful as the polycarboxylate additive. An excellent copolymer having the above Formula is acrylic acid/maleic acid copolymer. Those skilled in the art may also find that certain mixtures of polymers and copolymers according to the Formula heretofore set forth may also may utility as part of the degreaser composition, and therefore these are also within the scope of the invention.

Illustrative methods for preparing the various useful polycarboxylate polymers and copolymers of the invention may be found in Burke et al., U.S. Pat. No. 5,126,068, incorporated herein by reference.

An especially preferred monomer ratio for the polycarboxylate copolymer is about 1:1. A monomeric ratio within the range of about 3:1 to 1:3 is also preferred. A preferred molecular weight range is about 1,000 to 25,000, and even more preferably from about 8,000 to 12,000.

Especially useful copolymers as part of the degreaser composition include the following structures. A polycarboxylate copolymer with a molecular weight of about 12,000, and X=Na, A=COONa, A'=$C_5H_{11}$, A"=$CH_3$ and the monomeric ratio is about 1:1 (Polycarboxylate A in the examples). A polycarboxylate copolymer with a molecular weight of about 70,000, X=Na, A=COONa, A'=$OCH_3$, A"=H and the monomeric ratio is about 1:1. In addition, polyacrylic acid with a molecular weight of about 8,000, where X=Na is also effective as part of the invention. This polyacrylic acid may be obtained from BASF Corp. under the tradename of SOKALAN™ PA 30 CL.

The polycarboxylate polymer or copolymer as part of the invention is added to the degreaser composition in amounts of about 0.005 to 1 % by weight based upon the total weight of the composition. Preferably, the polymer or copolymer will comprise from about 0.01 to 0.5% of the total formulation.

The Utility of the Present Invention

The degreaser composition according to the various embodiments of the invention is extremely useful in industrial, institutional, and household cleaning and degreasing of hard surfaces, including but not limited to, glass, ceramic, rigid and flexible hard surfaces, and metal, especially automotive parts. The degreaser composition may be applied by methods including but not limited to dipping, soaking, wiping, sonicating, spraying, and especially pressure spray washing. Further, the degreaser composition may be applied at a wide range of temperatures from about 40 to 200° F.

The following non limiting examples illustrate the utility of the present invention: All percentages are weight percent unless otherwise indicated.

EXAMPLE 1

Meat Packing Equipment Cleaning Composition (a) 0.17–3.3% alcohol alkoxylate with a fatty alcohol moiety selected from the group of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_{12}$ to $C_{15}$ branched or straight chain alkyl group with approximately 10 moles total of oxyethylate and approximately 5 moles total of oxypropylate, wherein further, m is 1.5, n is 1, o is 9, p is 3.5.

(b) 0.17–3.3% polyoxyalkylene block copolymer of Formula II:

$$Y[(A)_o(EO)_m(A)_nH]_x$$

wherein A=oxypropylene and the molecular weight is about 2,500.

(c) 0.17–3.3% fatty alcohol having oxyethylate moieties of the Formula:

$$R(OCH_2CH_2)_xOH$$

wherein R=$C_{10}$ and x=4.

EXAMPLE 2

Household Hard Surface Cleaning Composition (a) 0.5–2% alcohol alkoxylate with a fatty alcohol moiety selected from the group of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_{12}$ to $C_{15}$ branched or straight chain alkyl group with approximately 10 moles total of oxyethylate and approximately 5 moles total of oxypropylate, wherein further, m is 1.5, n is 1, o is 9, p is 3.5.

(b) 0.5–2% of a polyoxyalkylene block copolymer of the Formula II:

$$Y[(A)_o(EO)_m(A)_nH]_x$$

wherein A=oxypropylene and the molecular weight is about 2,600.

(c) 0.5–2.0% of a fatty alcohol having an oxyethylate moiety of the Formula:

$$R\ (OCH_2CH_2)_x\ OH$$

wherein R=$C_{13}$ and x=10.

EXAMPLE 3

Household Carpet Cleaning Composition Comprising (a) 0.5–2% alcohol alkoxylate with a fatty alcohol moiety selected from the group of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_{12}$ to $C_{15}$ branched or straight chain alkyl group with approximately 10 moles total of oxyethylate and approximately 5 moles total of oxypropylate, wherein further, m is 1.5, n is 1, o is 9, p is 3.5.

(b) 0.5–2% of a polyoxyalkylene block copolymer of the Formula II:

$$Y[(A)_o(EO)_m(A)_nH]_x$$

wherein A=oxypropylene and the molecular weight is about 1,900.

(c) 0.5–2.0% of a fatty alcohol having an oxyethylate moiety of the Formula:

$$R\ (OCH_2CH_2)_xOH$$

wherein R=10 and x=4.

(d) 0.01–0.5% polycarboxylate polymers having the Formula:

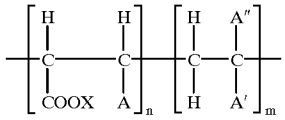

wherein x=H, A=H, A' is COOH, A"=H and m and n are numbers such that the monomer ratio is within the range of about 10:1 and the total molecular weight of the polymer or copolymer is about 1,000.

EXAMPLE 4

Industrial Degreasing Composition (a) 0.17–3.3% alcohol alkoxylate with a fatty alcohol moiety selected from the group of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_{12}$ to $C_{15}$ branched or straight chain alkyl group with approximately 10 moles total of oxyethylate and approximately 5 moles total of oxypropylate, wherein further, m is 1.5, n is 1, o is 9, p is 3.5.

(b) 0.17–3.3% of a polyoxyalkylene block copolymer of the Formula I:

$$Y[(A)_o(EO)_m(A)_nH]_x$$

wherein A=oxypropylene and the molecular weight is about 2,200.

(c) 017–3.3% of a fatty alcohol having an oxyethylate moiety of the Formula:

$$R\ (OCH_2CH_2)_xOH$$

wherein R=13 and x=10.

While the invention has been described in each of its various embodiments, it is to be expected that certain modifications thereto may be made by those skilled in the art without departing from the true spirit and scope of the invention as set forth in the specification and the accompanying claims.

We claim:

1. An aqueous based, solvent free degreaser composition, comprising on a weight basis:

(a) about 0.15–5.0% of one alcohol alkoxylate with a fatty alcohol moiety selected from the group consisting of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_8$ to $C_{18}$ branched or straight chain alkyl group, each of m, n, o and p is within the range of about 0 to 14, provided that at least one of m, n, o and p is not zero, each of R' and R" is —$CH_3$, —$CH_2CH_3$ or mixtures thereof, and R"' is —OH, —$CH_3$, —O—$C_3$–$C_{18}$ hydroxyalkyl group or mixtures thereof;

(b) 0.15–5% of a nonionic surfactant characterized as a block or heteric block polyoxyalkylene polymer having a cloud point in a 1 weight percent aqueous solution of about 10° C. to about 40° C. selected from the group consisting of at least one of the polyoxyalkylenes having the Formulas I, II, or III:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran and mixtures thereof, wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0 to 26, m is within the range of about 0 to 110, and n is within the range of about 0 to 26, wherein further the molecular weight is from about 1,000 to 20,000;

(c) 0.15–5% of one fatty alcohol, which is different from (a), containing oxyethylate moieties of the following Formula:

$$R(OCH_2CH_2)_xOH$$

wherein R is a $C_{12}$ to $C_{13}$ branched or straight chain alkyl group and x is within the range of about 4 to 10; and (d) water.

2. An aqueous based solvent free degreaser composition according to claim 1, wherein (b) is Formula II, A is oxypropylene and the molecular weight of said Formula II is 2,500.

3. An aqueous based solvent free degreaser composition according to claim 1, wherein in (c), R=$C_{13}$ and x=10.

4. An aqueous based solvent free degreaser composition according to claim 1, wherein (a), R is $C_{12\text{-}15}$ branched or straight chain alkyl group with approximately 10 moles total of oxyethylate and approximately five moles total of oxypropylate, wherein further m=1.5; n=1; o=9; and p=3.5; in Formula II of (b), A=oxypropylene and the molecular weight is 2,200; and in (c), R=$C_{13}$ and x=10.

5. An aqueous based, solvent free degreaser composition, comprising on a weight basis:

(a) about 0.15–5.0% of one alcohol alkoxylate with a fatty alcohol moiety selected from the group consisting of compounds of the Formula:

$$R[(OCH\underset{\underset{R'}{|}}{C}H_2)_m/(OCH_2CH_2)_n][(OCH_2CH_2)_o/(OCH_2\underset{\underset{R''}{|}}{C}H_2)_p]R'''$$

wherein R is a $C_8$ to $C_{18}$ branched or straight chain alkyl group, each of m, n, o and p is within the range of about 0 to 14, provided that at least one of m, n, o and p is not zero, each of R' and R" is —$CH_3$, —$CH_2CH_3$ or mixtures thereof, and R"' is —OH, —$CH_3$, —O—$C_3$–$C_{18}$ hydroxyalkyl group or mixtures thereof;

(b) 0.15–5% of a nonionic surfactant characterized as a block or heteric block polyoxyalkylene polymer having a cloud point in a 1 weight percent aqueous solution of about 10° C. to about 40° C. selected from the group consisting of at lest one of the polyoxyalkylenes having the Formulas I, II, or III:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran and mixtures thereof, wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0 to 26, m is within the range of about 0 to 110, and n is within the range of about 0 to 26, wherein further the molecular weight is from about 1,000 to 20,000;

(c) 0.15–5% of one fatty alcohol, which is different from (a), containing oxyethylate moieties of the following Formula:

$$R(OCH_2CH_2)_xOH$$

wherein R is a $C_{12}$ to $C_{13}$ branched or straight chain alkyl group and x is within the range of about 4 to 10;

(d) 0.01–0.5% of a polycarboxylate polymer or copolymer having the Formula:

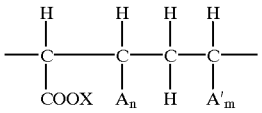

wherein x=H, alkali metal or alkaline earth metal, A=H or COO—Y, A'=COO—Y, —$CH_3$ or an alkyl group having a chain length of about 4 to 20 carbon atoms, and wherein Y is H or an alkali metal, A"=H or $CH_3$, and m and n are numbers such that the monomer ratio is within the range of about 10:1 to 1:10 and the total molecular weight of the polymer or copolymer is within the range of about 1,000 to 70,000; and (e) water.

6. An aqueous based, solvent free degreaser composition, comprising on a weight basis:

(a) about 0.15–5.0% of one alcohol alkoxylate with a fatty alcohol moiety selected from the group consisting of compounds of the Formula:

$$R[(\underset{\underset{R'}{|}}{C}HCH_2)_m/(OCH_2CH_2)_n][(OCH_2CH_2)_o/(OCH_2\underset{\underset{R''}{|}}{C}H_2)_p]R'''$$

wherein R is a $C_{12-15}$ branched or straight chain alkyl group with approximately 10 moles total of oxyethylate and approximately five moles total of oxypropylate, m=1.5, n=1, o=9, p=3.5, each of R' and R" is —$CH_3$, —$CH_2CH_3$ or mixtures thereof, and R"' is —OH, —$CH_3$, —O—$C_3$–$C_{18}$ hydroxyalkyl group or mixtures thereof;

(b) 0.15–5% of a nonionic surfactant characterized as a block or heteric block polyoxyalkylene polymer having a cloud point in a 1 weight percent aqueous solution of about 10° C. to about 40° C. selected from the group consisting of at lest one of the polyoxyalkylenes having the Formulas I, II, or III:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

wherein, Y represents the nucleus of an active hydrogen-containing organic compound having a functionality of x and (1) about 2 to about 6 carbon atoms and 2 to 3 reactive hydrogen atoms or (2) about 6 to about 18 carbon atoms and 1 to 3 reactive hydrogen atoms; A represents a lower alkylene oxide selected from the group consisting of propylene oxide, butylene oxide, tetrahydrofuran and mixtures thereof, wherein up to 25 percent by weight of A is reacted directly with said organic compound either alone in Formulas II and III or in admixture with ethylene oxide in Formula I and 75 percent by weight or more of A is subsequently reacted to produce said polymer; o is within the range of about 0 to 26, m is within the range of about 0 to 110, and n is within the range of about 0 to 26, wherein further the molecular weight is from about 1,000 to 20,000;

(c) 0.15–5% of one fatty alcohol, which is different from (a), containing oxyethylate moieties of the following Formula:

$$R(OCH_2CH_2)_xOH$$

wherein R is a $C_{12}$ to $C_{13}$ branched or straight chain alkyl group and x is within the range of about 4 to 10; and (d) water.

7. An aqueous based solvent free degreaser composition according to claim 6, wherein, in Formula II in (b), A=oxypropylene and the molecular weight is 2,200.

8. An aqueous based solvent free degreaser composition according to claim 6, wherein, in (c), R=$C_{13}$ and x=10.

9. An aqueous based solvent free degreaser composition according to claim 6, wherein (b) is Formula II, A is oxypropylene and the molecular weight of said Formula II is 2,500.

10. An aqueous based solvent free degreaser composition according to claim 9, wherein in (c), R=$C_{13}$ and x=10.

* * * * *